US006464476B2

(12) United States Patent
Ross et al.

(10) Patent No.: US 6,464,476 B2
(45) Date of Patent: Oct. 15, 2002

(54) LINEAR PUMP AND METHOD

(76) Inventors: Anthony C. Ross, 3546 Maybank Hwy., John's Island, SC (US) 29455; Peter A. Guagliano, 2285 Marsh Hen Dr., John's Island, SC (US) 29455

( * ) Notice: Subject to any disclaimer, the term of this patent is extended or adjusted under 35 U.S.C. 154(b) by 0 days.

(21) Appl. No.: 09/747,832

(22) Filed: Dec. 22, 2000

(65) Prior Publication Data

US 2002/0081207 A1 Jun. 27, 2002

(51) Int. Cl.[7] ..... F04B 43/08; F04B 43/10; F04B 17/00; A61M 1/00; B01D 63/00

(52) U.S. Cl. ..... 417/478; 417/392; 417/394; 604/153; 210/321.78; 210/323.2

(58) Field of Search ..... 417/313, 392, 417/394, 478; 604/153; 210/321.78, 323.2

(56) References Cited

U.S. PATENT DOCUMENTS

| | | | | | |
|---|---|---|---|---|---|
| 1,546,973 | A | * | 7/1925 | Ellis | 166/105.4 |
| 2,807,216 | A | * | 9/1957 | Bielstein | 417/392 |
| 2,815,715 | A | * | 12/1957 | Tremblay | 128/DIG. 3 |
| 3,048,121 | A | * | 8/1962 | Sheesley | 24/191 |
| 3,216,413 | A | * | 11/1965 | Mota | 128/205.13 |
| 3,783,453 | A | * | 1/1974 | Bolie | 417/212 |
| 3,839,983 | A | * | 10/1974 | McAusland | 114/183 A |
| 4,076,467 | A | * | 2/1978 | Persson | 417/478 |
| 4,439,112 | A | * | 3/1984 | Kitsnik | 417/383 |
| 4,744,900 | A | * | 5/1988 | Bratt | 210/321.78 |
| 5,209,654 | A | * | 5/1993 | Nilsson et al. | 417/478 |
| 5,411,381 | A | * | 5/1995 | Perrodin | 417/472 |
| 5,676,162 | A | | 10/1997 | Larson, Jr. et al. | 128/899 |
| 5,676,651 | A | | 10/1997 | Larson, Jr. et al. | 604/33 |
| 5,693,091 | A | | 12/1997 | Larson, Jr. et al. | 612/3 |
| 5,722,930 | A | | 3/1998 | Larson, Jr. et al. | 600/16 |
| 5,758,666 | A | | 6/1998 | Larson, Jr. et al. | 128/899 |
| 5,879,375 | A | | 3/1999 | Larson, Jr. et al. | 607/30 |
| 6,352,455 | B1 | * | 3/2002 | Guagliano et al. | 417/412 |

* cited by examiner

*Primary Examiner*—Charles G. Freay
*Assistant Examiner*—Timothy P. Solak
(74) *Attorney, Agent, or Firm*—Browning Bushman, P.C.

(57) ABSTRACT

The linear pump (10,110) includes a housing (12, 112) and either two(20, 22) or one (120) flexible bladders each within a pump housing and interconnected to respective end caps (30, 32, 130, 132, 134, 136). Upon movement of a movable end cap relative to a stationary end cap, the volume in each bladder may be variably controlled to pump blood or another selected fluid. Linear movement of the end caps may be controlled by an attractive or repulsive force between end caps. The pump (110) with a permeable bladder (120) may be used to pump wastewater.

25 Claims, 1 Drawing Sheet

LINEAR PUMP AND METHOD

FIELD OF THE INVENTION

The present invention relates to pumps, and more particularly to improvements in reciprocating linear pumps. The linear pump of the present invention is relatively simple and thus inexpensive to manufacture and maintain, yet has a surprisingly high pump efficiency. The pump of the present invention is particularly well suited for pumping blood intracorporeal or extra-corporeal bridge to a transplant or a total cardiac replacement. The pump may alternatively be used to pump sewage or wastewater, or may be used in other industrial, commercial, medical, astronautical, aeronautical, or military applications.

BACKGROUND OF THE INVENTION

Pumps have been used for centuries, and various types of pumps have been devised, including positive displacement pumps, rotary pumps, vane pumps, and centrifugal pumps. While many of these pumps are well suited for particular uses, pumps in general do not have a high efficiency, and are not well suited for special applications, such as pumping blood or pumping sewage wastewater.

Current pumps include the crew of Archimedes that interferes with axial blood flow. Many pumps cause damage to the blood components as these blood components make either direct or near contact that surfaces of the pump. Ventricular assist pumps currently employ mechanisms to move blood that stresses the blood in some situations and are non-pulsatile.

When pumping blood, constant flow by conventional pumps may cause "pumphead" because of the sustained vasiodilation. The alterations in the cellular components of the blood, typical with rotary and constant flow pumps, may be due to reactions with the vasodialted capillaries and the components of the blood reacting to this abnormal state. Ischemia may be present to the decreased lumen secondary to an accumulation of platelets and/or the blood not pulsing enough to create turbulence and transfer the gases and nutrients. This would thus be analogous to going too fast by a road sign. It may be due to the hemodynamics of fluid flow with a non-newtonian fluid. The pulse flow preferably allows for a psychological pause in the short duration dilated phase and the contraction may facilitate the movement of the blood components.

Various types of linear pumps have been devised, including linear pumps particularly intended for pumping blood. U.S. Pat. Nos. 5,676,162 and 5,879,375 disclose reciprocating pump and linear motor arrangements for pumping blood. The assembly includes a piston-valve which is placed at the inlet end of a hollow chamber. The valve leaflets may be in any arbitrary position. The pump module arrangement may occupy a space of no more than approximately 6 cm. in diameter and 7.5 cm. long. In a preferred embodiment, a quick connect locking system may be utilized, as shown in FIG. 3 of the '162 Patent. FIG. 11 of the '375 Patent illustrates the anatomical arrangement of a surgically implantable pump with a reciprocating piston-valve. Other patents directed to implantable pumps and or linear pumps include U.S. Pat. Nos. 5,676,651, 5,693,091, 5,722,930, and 5,758,666.

Conventional pumps have long been used to pump a slurry consisting of a fluid and a semi-solid material, which is common in sewage wastewater. Conventional wastewater pumps have significant problems due to pump plugging and abrasion, which increases repair and maintenance costs, and results in poor pump efficiency and/or short pump life.

The disadvantages of the prior art are either overcome or are reduced by the present invention, and improved linear pumps and methods of pumping fluids are hereinafter disclosed which overcome many of the disadvantages of prior art pumps, including relatively high cost of manufacture and/or poor pump efficiency.

SUMMARY OF THE INVENTION

The present invention is directed to highly versatile linear pumps. In one embodiment the pump may be used for pumping blood through a living body, and it may include a pump housing having a non-oxygenated blood inlet, a non-oxygenated blood outlet, an oxygenated blood inlet, and an oxygenated blood outlet. The pump may include both a non-oxygenated bladder and an oxygenated bladder each for receiving and for outputting blood at a desired pulse rate. The pump may further include a non-oxygenated blood inlet check valve, a non-oxygenated outlet check valve, an oxygenated blood inlet check valve, and an oxygenated blood outlet check valve for passing the blood through the pump. An inlet plate and an outlet plate may be secured to corresponding ends of each of the two bladders. The pump includes a prime mover for linearly moving an inlet plate secured to a respective bladder with respect to an outlet plate secured to the same bladder such that linear movement of the inlet plate with respect to the outlet plate alters the volume within the bladder to pump the blood. A control member is provided for controlling linear movement of the end plates and thereby controlling the first pulse rate and the second pulse rate caused by the pumping action of the first bladder and the second bladder, respectively. The pump flow for the decreased demand of the right ventricle may be accommodated by pump size, output, bladder size, or stroke volume.

The pump may be used extra-corporeal as a single unit to move blood through the inner chamber and a lubricant/thermal fluid through the outer chamber to maintain a comfortable state for the patient treated. The fluid that is passed through the outer chamber may be such to facilitate components to be moved through a selectively permeable inner bladder. This use is in a dialysis-like setting. Another embodiment only utilizes the inner chamber for fluid movement to realize the benefit of the parastalyic movement.

In still another embodiment, the pump may assist the heart as a left ventricular assist device with configuration and attachment such as is found in the Heart Mate II LVAS. In yet another embodiment, the pump is used as a wastewater pump and includes a housing having a throughbore about a central axis, an incoming end cap and outflowing end cap, a flexible generally tubular bladder defining an inner chamber and an outer chamber, an incoming inner chamber check valve, an outflowing inner chamber check valve, at least one incoming outer chamber check valve, at least one outflowing outer chamber check valve, and a power supply with electronics for controlling the attraction and repulsion of the end caps to cyclically move one end cap with respect to the other end cap along a central axis in a manner which cyclically varies the volume of both the inner chamber and the outer chamber, thereby creating propulsion forces and pumping the wastewater.

The pump according to the present invention may utilize magnetic propulsion and contraction forces to change the length and thus the internal volume within a flexible bladder, which may be reinforced with a weave comprising fibrous reinforcing members. In an alternate embodiment, hydraulic power to cylinders is controlled to effect movement of the end caps and thereby cyclically change the volume of the inner chamber and the outer chamber which are separated by the bladder. Volume changes within the bladder and in many applications between the bladder and the external housing may be used to generate the pumping forces.

To create compressive forces to move fluid, the pump may utilize one or more inner chambers and corresponding outer chambers which may each contribute to the pumping of fluid. The pump according to the present invention thus may fill an outer chamber with fluid as the inner chamber is venting, then fill the inner chamber with fluid while the outer chamber is venting. This feature minimizes the pressure differential, which decreases the work and thus the effort needed for the pump.

In one embodiment, the pump is used as a blood pump and two bladders are provided, preferably with counter offset check valves to ideally balance the pump operation with due concern to output demands. For this embodiment, the chamber exterior of the bladders may be vented to atmosphere, or alternatively may be provided with another desired fluid.

In an another embodiment, the pump is used as a wastewater pump, and in that case preferably the chamber exterior to the bladder is sealed within the housing, such that the bladder creates both an inner chamber and an outer chamber. The wastewater fluid flows through each chamber to efficiently pump wastewater. In one embodiment, the bladder itself may be permeable such that relatively clean wastewater passes from within the bladder radially outward to the outer chamber, thereby contributing to the volume of relatively clean wastewater in the outer chamber and thus minimizing the volume of relatively dirty wastewater which must be treated in a manner more costly than the relatively clean wastewater. The proportion of the pump will vary with the rate of transfer through the walls.

It is a feature of the invention that the pump may utilize valves which include polymer reeds that are in a tricuspid and/or bicuspid configuration similar to that of a human heart valve. Each valve in the device may be sized analogous to cardiac portions in the heart valve. The valves preferably are self-cleaning and quiet, and also have high efficiency and longevity.

It is a further feature of the invention that the material which provides the helix reinforcement may be formed of a carbon fiber, an aromatic polyamide fiber such as Kevlar, or currently advanced reinforcement which has significantly better fatigue properties than metal wire.

It is another feature of the invention that when the pump is used as a wastewater pump, the bladder may be permeable such that relatively wastewater may pass from the interior of the bladder through the bladder and to the exterior of the bladder, thereby minimizing the volume of relatively dirty wastewater which must be treated.

It is a further feature of the invention that the end caps may be both configured and provided with a suitable sealing member for obtaining a reliable fluid tight seal between both the stationary and the movable end caps, whether that seal be made with blood vessels, a wastewater pipeline, or other fluid conduit.

In another embodiment, the pump may be used to move fluids necessary to operate machinery and equipment to include, but not limited to, submarines, boats, airplanes, aerospace and spacecraft. Due to the minimal size, weight, and parts, the pump may allow for an increased payload.

Another feature of the invention is that the pump utilizes moving parts that are forgiving.

The pump according to the present invention is highly versatile; the length of the pump stroke may be complete or partial.

A further feature of the invention is that the pump may utilize attracting and repelling end caps and conventional sealing members, such as o-rings with reduced friction, to form reliable seals within the device.

It is a further feature of the invention that the end caps may be provided with a TEFLON™ coating. Alternatively, the end caps may be coated with a fine diamond material to create a very low friction surface for sealing between the movable end cap and the housing.

Yet another feature of the invention is that the pump may be electrically powered to change the magnetic attraction and repulsion of the end caps, or may be hydraulically powered to serve this same purpose.

An advantage of the invention is that the pump is relatively simple and thus highly reliable. The further advantage of the invention is that the pump may provide a relatively long life with few service problems.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
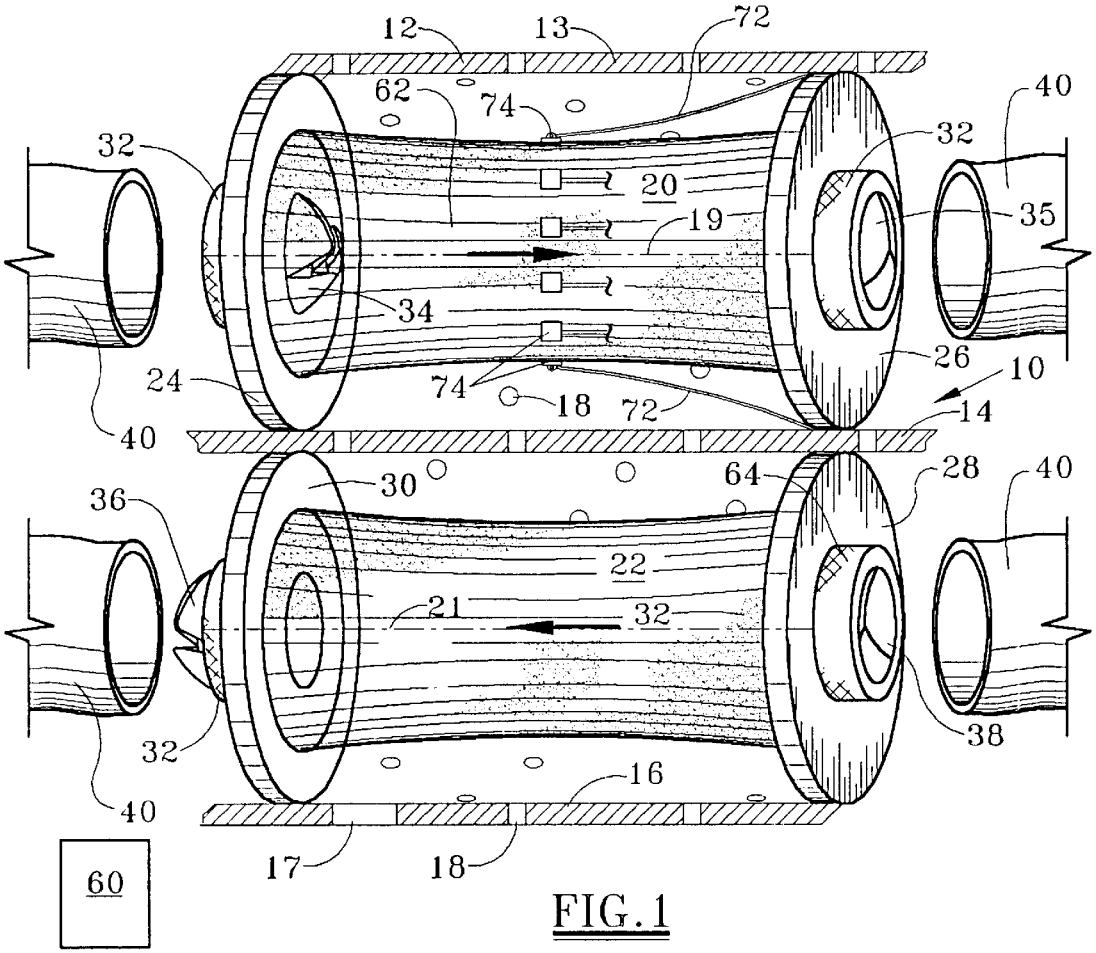
FIG. 1 is a simplified pictorial view, partially in cross section, of a suitable blood pump according to the present invention.

FIG. 1 illustrates a preferred pump according to the present invention suitable for pumping blood. Most importantly, the pump 10 as shown in FIG. 1 does not create a "pump head" because of sustained vasiodillation. The pump 10 ideally results in a pulse flow which allows for a physiological pause in the short duration dilated phase, and accordingly the contraction may facilitate the movement of blood components. The pump 10, when used to pump blood, thus desirably has a pulse flow such that there may be a pause at the end of each stroke.

The pump 10 as shown in FIG. 1 thus contains two separate bladder 20 and 22 each positioned within the housing 12. The housing 12 itself may consider a top housing portion 13 for fixed and sealed engagement with the end cap 24 and for sealed engagement with the movable end cap 26. The lower housing portion 16 may similarly include an end cap 28 fixed and sealed to the housing 13, while the movable end cap 30 seals with the housing 16 during reciprocation of the movable end cap 30. As shown in FIG. 1, an intermediate housing portion 14 may be provided between what is generally an upper pump body or housing 13 and a lower body or housing 16 for enclosing the upper bladder 20 and the lower bladder 22. The housings 13 and 16 may be formed as an integral housing, or if desired may be spacially separated to reduce the shock of movement by a resilient bladder material. The housing 13, 16 may or may not be attached to each other.

As shown in FIG. 1, the housing 12 may contain numerous openings 18 for venting the chamber exterior of the bladders 20 and 22 to ambient. Slots 17 may be used instead of, or in conjunction with, holes otherwise configured apertures.

The pump 10 includes an incoming non-oxygenated blood check valve 34 and an outgoing non-oxygenated check valve 35. The pump also includes an incoming oxygenated check valve 38 and an outgoing oxygenated check valve 36. As shown in FIG. 1, exterior surfaces 32 on end cap extension 64 may be configured or provided with a desired sealing member for sealing engagement of the flow line 40, which in this case preferably is a blood vessel, to seal the flow line with a respective end cap. Control member 60 is provided for controlling the attraction and repulsion of the movable end caps with respect to the respective end cap and thereby pump blood to the living body.

Each variable inner chamber of the pump may allow for the parastalic movement of the blood through the heart-like valves into a throbbing tube, thereby mimicking a blood vessel. Since housing 12 is slotted or otherwise includes openings, the outer chamber of the housing 12 may simply be vented to ambient. Alternatively, the outer chamber may contain a psychological compatible fluid to balance and regulate the desired temperature of the blood.

Left ventricular-assist systems such as the Heart Mate II are designed to take over the function of the main pumping ventricle to generate force to propel oxygen-rich blood throughout the body. The components of this invention include a titanium pump and inlet cannula, a percutaneous cable, a flow probe and an outflow graft. An external battery pack and system driver may power the pump, which may be strapped onto the body over the shoulders.

An external corporeal single unit (pump) may be used with technology from the present invention to pump blood to the body from outside of the body, such as may be needed for surgical procedures.

The use of the linear motor according to the present invention allows one to individualize the rate, amplitude, force, and pulse volume that is specific to a particular patient. The pump 10 may thus be used as an inter-ventricular blood pump or as an extra-ventricular blood pump. In either case, the pump preferably includes two flexible bladders 20 and 22 and thus two pumps, which are preferably placed side-by-side, thereby providing a "double barrel" arrangement which allows the movable components of the pump to move in opposing directions in each of the pump "barrels" . One of the barrels thus preferably pumps non-oxygenated blood, while the other barrel pumps oxygenated blood. The outer chamber of each barrel may be slotted or parted, so that blood only flows into the interior of the bladder. The bladder according to the present invention preferably has a desired elasticity which results in a highly efficient pump, thereby resulting in a very small battery pack to power the pump, which is particularly important for inter-ventricular applications. Each bladder is preferably concentric about an axis 19, 21, and these are preferably parallel, as shown in FIG. 1. The actual pump size, bladder size, output size or volume output may be altered to accommodate specific physiological needs.

The pump 10 shown in FIG. 1 results in substantially reduced shear forces and high efficiency. Since the outer housing 12 may be vented, only the interior of the bladder pumps blood. In another variation of the blood pump, the bladders 20 and 22 may be made from an elastic membrane which limits extension of the bladder and cushions that extension. The stretched elasticity of the membrane must thus return the membrane to the retracted position. Accordingly, power need only be used to drive each movable plate linearly in one direction.

A particularly significant feature of the present invention is that all components which contact the blood may be made from a hydrocarbon-based polymer. By making the bladder of an elastic membrane, this limits the extension and cushions the effect of the extension. Also, the bladder may be formed from a biological membrane, such as human tissue or skin, thereby rendering the device compatible with the individual patient to reduce the likelihood of infection or rejection of the pumped blood. The pump bladder material may also be a biologically generated tissue.

Figure 2:
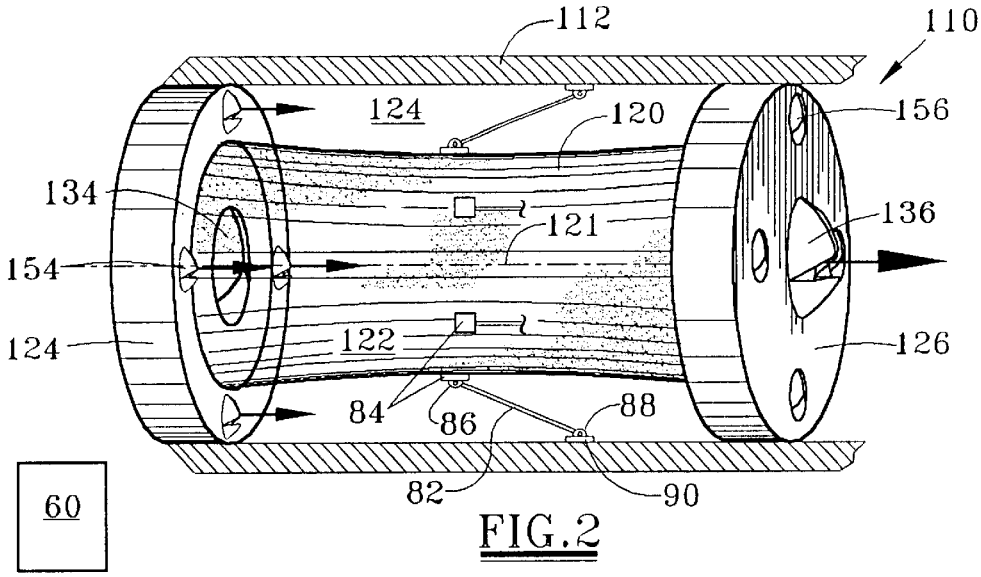
FIG. 2 is a simplified pictorial view, partially in cross section, of a suitable wastewater pump according to the present invention.

In other applications, the pump according to the present invention may be used to pump sewage in a manner which will result in a minimum of any plugging of the pump and relatively low wear and maintenance compared to prior art pumps. The pump 110 as shown in FIG. 2 thus fulfills the need of moving waste fluids, which may contain fecal waste. The pump 110 has significant advantages since it contains very few moving parts. Moreover, the pump and the motor may be fabricated as one unit. The design according to the present invention also allows for dimensions to be contiguous with current piping. Unlike a conventional lift station, the pump 110 according to the present invention may be used with a casing size which is minimized. Power cables often accompany the water and waste pumps in the easement, thereby making the source of power commonly available. The design according to the present invention allows for easy installation, field replacement, and field and/or bench repair. The pump 110 works as a parastalysis which is similar to biological movement when other forces, such as gravity, must be overcome.

The pump 110 thus includes a housing 112 which contains the bladder 120. The bladder 120 is preferably concentric about axis 121. An inlet check valve 134 is provided for allowing relatively dirty fluid to flow into the interior of the bladder 120, while outlet check valve 136 allows the dirty fluid to be discharged from the pump as the volume of the chamber 122 changes in response to linear movement of the movable end cap with respect to the stationary end cap. In this application, a relatively clean wastewater fluid may flow into the chamber 124 exterior of the bladder 120 by passing through one or more of a plurality of relatively clean wastewater inlet check valves 154. Relatively clean wastewater is discharged from the pump 110 through one or more of a plurality of relatively clean wastewater fluid outlet check valves 156. A suitable control member 60 is provided for controlling the attraction and repulsion of the movable end cap with respect to the stationary end cap and thereby pump wastewater through the pump.

For a sewage pump application, the bladder or membrane 120 may be slightly porous such that clean fluid may pass radially outward through the membrane 120, and relatively dirty fluid pumped through the chamber 122 within the bladder 120, while relatively clean fluid is pumped in the chamber 124 exterior of the bladder. When used as above wastewater pump, the pump 110 yields surprisingly good results. The pump is highly efficient, thereby requiring a relatively small power source size. The motor for driving the pump according to the present invention may be a biological filter, which provides an extremely high efficiency filtration unit which is particularly useful for use as a wastewater pump. In still another embodiment, the pump according to the present invention may be used as a part of or a support to a more extensive system, such as a submarine.

Yet another feature of the invention relates to the use of mechanisms to facilitate the desired compression of the bladder and thereby the emptying of the fluid within the bladder during the pumping cycle. In one embodiment, a plurality of the elongate flexible rubber-like stretchable bands or tethers 72 may be circumferentially arranged about the bladder, with the tethers being secured at one end to an outer surface of the bladder and at the other end to the moveable end plate. Referring again to FIG. 1, a plurality of attachment pads 74 as shown in FIG. 1 may be glued, stitched or otherwise fixedly secured to an outer surface of the bladder 20. One end of each of the plurality of the circumferentially arranged tethers 72 is thus secured to a respective attachment pad, with the opposing end of each flexible tether being secured in a conventional manner to moveable end plate 26. Both the bladder and the tethers may thus be stretched during propulsion of the end cap 26 relative to the end cap 24. The plurality of circumferential tethers 72 may thus be used to facilitate emptying of the fluid from within the bladder 20 and through the check valve 38. Alternatively, the tethers could be secured to the bladder 20 and the fixed plate 24, and each tether would stretch during elongating of the bladder. Tethers affixed to either or both end plates and the bladder thus produce a variable force which desirably alter the attraction of the end plates.

In another embodiment, a plurality of circumferentially spaced hinged members 82 may be provided, as shown in FIG. 2. One end of each hinge member may thus be pivotally secured to a respective pad 84 secured to the bladder 120, while the other end of the hinge member is pivotally secured to a respective attachment pad 90, which in turn secured to the housing 112. The hinge members 82 may each pivot about axis 86 relative to the respective pad 84, and similarly may hinge about the axis 88 with respect to housing 112. The hinge members 82 thus alter the radially spacing of at least a portion of the bladder with respect to the housing as a function of the axial between the end plates. It should be appreciated that the pads 90 as discussed herein are spaced axially closer to the fixed end plate 124 than the closest axial position of the movable end plate 126 relative to the fixed plate 124, so that the pads do not interfere with travel of the movable end plate 126. The desired pumping objective may be obtained while still providing the desired pivoting action of the plurality of hinge members 82 to accomplish the goal of facilitating the compression of the inner bladder and thereby emptying the bladder 120 more fully when the plate 126 is repelled from the plate 124.

For each of the above embodiments, all end surfaces of the movable end caps are preferably coated. End cap surfaces may be coated with polytetrafluoroethylene, e.g., TEFLON™. In the alternative, these surfaces may be coated with a diamond powder or other technologically advanced material to provide a highly efficient non-stick surface.

The term "blood" is used herein as intended in its broadest sense to encompass all forms of life supplying fluid to a living body. As previously indicated, the pump design as shown in FIG. 1 is well suited for achieving the objectives, features, and advantages of the present invention.

The term "inlet plate" "outlet plate" as used herein are intended in the broadest sense to cover any member at the respective end of the bladder. The inlet and outlet plate thus may have a substantially dissimilar size to the inlet plates shown in the drawing. The term "bladder" as used herein is intended in its broadest sense to include any elastomeric flexible material. The inlet plate and the outlet plate thus may be any structural members connecting the ends of the bladder with the pump driving mechanism.

When used as a wastewater pump, sludge and other solid material in the wastewater preferably flows from the interior of the bladder radially outward through the bladder and thus to the exterior of the bladder. The bladder itself is preferably permeable, so that at least some of the water in the wastewater mixture may pass radially outward through the bladder and mix with the other relatively clean water being pumped in the variable chamber 124 exterior of the bladder 120 but may be non-permeable. Water flowing through the bladder minimizes the volume of material that must be treated as a waste material product.

The term "wastewater" is used herein as intended in its broadest sense to encompass all combinations of water and waste material, including sludge, sewage, sediment, and other storm drainage materials. The wastewater pump as generally shown in FIG. 2 is similarly well suited for pumping fluids other than water, with or without sludge, sediment, or other solid or semisolid fluid or other material.

It will be understood by those skilled in the art that the embodiment shown and described is exemplary and various other modifications may be made in the practice of the invention. Accordingly, the scope of the invention should be understood to include such modifications which are within the spirit of the invention.

What is claimed is:

1. A blood pump for pumping blood, comprising:

a pump housing having a non-oxygenated blood inlet, an non-oxygenated blood outlet, an oxygenated blood inlet, and an oxygenated blood outlet;

a non-oxygenated bladder for receiving non-oxygenated blood and for outputting non-oxygenated blood at a first pulse rate;

an oxygenated bladder for receiving oxygenated blood and for outputting oxygenated blood at a second pulse rate;

a non-oxygenated blood inlet check valve for inputting non-oxygenated blood into the non-oxygenated bladder;

a non-oxygenated blood outlet check valve for outputting non-oxygenated blood from the non-oxygenated bladder;

an oxygenated blood inlet check valve for inputting oxygenated blood into the oxygenated bladder;

an oxygenated blood outlet check valve for outputting oxygenated blood from the oxygenated bladder;

an inlet plate secured to an inlet end of each bladder;

an outlet plate secured to an outlet end of each bladder;

a prime mover for linearly moving one of the inlet plate and the outlet plate with respect to the other of the inlet plate and the outlet plate secured to the same bladder, thereby altering the volume within the bladder to pump the blood; and a control member for controlling linear movement of each of the movable plates in axially opposing directions while controlling the first pulse rate and the second pulse rate.

2. The blood pump as defined in claim 1, wherein the prime mover is electrically powered to generate attractive and repulsive forces, and wherein each movable plate is linearly movable relative to a repulsive plate fixed to the pump housing in response to the attractive and repulsive forces.

3. The blood pump as defined in claim 1, wherein the prime mover includes one or more of an electrically powered prime mover and a hydraulically powered prime mover.

4. The blood pump as defined in claim 1, wherein the control member controls the second pulse rate as a function of a pulse signal in response to the first pulse rate.

5. The blood pump as defined in claim 1, wherein the control member is responsive to a position of each movable end plates with respect to the respective fixed end plate.

6. The blood pump as defined in claim 1, wherein an exterior or each of the non-oxygenated bladder and the oxygenated bladder are vented through the pump housing to ambient.

7. The blood pump as defined in claim 1, wherein an exterior of the non-oxygenated bladder and the oxygenated bladder are substantially filled with a desired fluid to achieve a selected temperature of the blood being pumped through the housing.

8. The blood pump as defined in claim 1, wherein the control member controls a selected linear rate, amplitude, force, and pulse volume of the blood pump.

9. The blood pump as defined in claim 1, wherein each of the inlet plates and outlet plates has a sealing surface compatible for receipt of a blood vessel.

10. The blood pump as defined in claim 9, wherein the sealing member is one of a polytetrafluoroethylene and a diamond powder coating.

11. The blood pump as defined in claim 1, further comprising:

a plurality of elongate flexible tethers each secured at one end to the bladder and an opposing end to a selected one of the inlet plate and outlet plate, such that each of the plurality of flexible elongate tethers produces a variable force which alters the attraction or repulsion of the end plates.

12. The blood pump as defined in claim 1, further comprising:

a plurality of circumferentially spaced hinge members each pivotally secured at one end to the bladder and an opposing end to the housing, such that the pivot members alter a radially spacing of at least a portion of the bladder with respect to the housing as a function of the axial spacing between the end plates.

13. A wastewater pump for pumping wastewater, comprising:

a housing having a throughbore about a central axis;

an incoming end cap and an outflowing end cap each mounted along said throughbore and spaced axially from each other, one of said end caps being mounted for movement along the central axis relative to both the other end cap and the housing, such that the housing guides axial movement of the movable end cap;

a flexible generally tubular bladder interconnected at one end to said incoming end cap and at an opposite end to said outflowing end cap, the bladder defining (a) an inner chamber therein between the end caps, and (b) an outer chamber between the bladder and the housing and between the end caps;

an incoming inner chamber check valve along a flow path interconnecting wastewater with the inner chamber;

an outflowing inner chamber check valve along a flow path interconnecting the inner chamber with wastewater;

at least one incoming outer chamber check valve each along a flow path interconnecting wastewater with the outer chamber;

at least one outflowing outer chamber check valve each along a flow path interconnecting the outer chamber with wastewater; and a power supply for controlling the attraction and repulsion of the end caps to cyclically move one end cap with respect to the other end cap and the housing along the central axis in a manner which cyclically varies the volume of both the inner chamber and the outer chamber, thereby creating pumping forces and pumping wastewater.

14. A wastewater pump as defined in 13, wherein at least one of the incoming end caps and the outflowing end caps include a sealing member for sealing engagement with wastewater tubular bladder.

15. A wastewater pump as defined in 13, wherein the pump has an inlet portion receiving substantially dirty wastewater and an outlet for outputting substantially clean wastewater and the bladder is permeable for transmitting the substantially clean wastewater from the dirty wastewater stream within the bladder to a substantially clean wastewater chamber exterior of the bladder.

16. A wastewater pump as defined in 13, further comprising:

the incoming end cap, housing the at least one incoming outer chamber check valve, and the outflowing end cap, housing the at least one outflowing outer chamber check valve.

17. A wastewater pump as defined in 13, wherein the prime mover is electrically powered to generate alternative repulsive forces, and wherein the inlet plate is linearly movable relative to the outlet plate in response to the attractive and repulsive forces.

18. A wastewater pump as defined in 13, wherein the prime mover includes one or more of an electrically powered prime mover and hydraulically powered prime mover.

19. A wastewater pump as defined in 13, wherein the power supply includes a control member for controlling linear movement of the movable end cap.

20. A wastewater pump as defined in 19, wherein the control member is responsive to a position of the movable end plate with respect to the fixed end plate.

21. A wastewater pump as defined in 13, further comprising:

a control member for controlling a selected linear rate, amplitude, force, and pulse volume of the wastewater pump.

22. A method of pumping fluid, comprising:

providing a housing having a throughbore about a central axis;

providing an incoming end cap and an outflowing end cap each mounted along the throughbore and spaced axially from each other, one of said end caps being mounted for movement along the central axis relative to the other end cap, such that the housing guides axial movement of the movable end cap;

interconnecting a flexible generally tubular bladder to said incoming end cap and at an opposite end to said outflowing end cap, the bladder defining (a) an inner chamber therein between the end caps and (b) an outer chamber between the bladder and the housing and between the end caps;

providing a check valve to limit flow interconnecting the fluid with the inner chamber;

providing an outflowing inner chamber check valve interconnecting the inner chamber with fluid;

providing at least one incoming outer chamber check valve for interconnecting fluid with the outer chamber;

providing at least one outflowing outer chamber check valve for interconnecting the outer chamber with fluid;

controlling the attraction and repulsion of the end caps to cyclically move one end cap with respect to the other end cap and the housing along the central axis in a manner which cyclically varies the volume of both the inner chamber and the outer chamber, thereby creating pumping forces and pumping the fluid.

23. The method as defined in claim 22, further comprising:

venting the outer chamber to atmosphere.

24. The method as defined in claim 22, further comprising:

securing each of a plurality of elongate flexible tethers at one end to the bladder and an opposing end to a selected one of the inlet plate and outlet plate, such that each of the plurality of flexible elongate tethers produces a variable force which alters the attraction of the end plates.

25. The method as defined in claim 22, further comprising:

pivotally securing each of a plurality of circumferentially spaced hinge members at one end to the bladder and an opposing end to the housing, such that the hinge members alter a radially spacing of at least a portion of the bladder with respect to the housing as a function of the axial spacing between the end plates.

* * * * *